United States Patent [19]

Frankel

[11] Patent Number: 5,050,746

[45] Date of Patent: Sep. 24, 1991

[54] ROTARY SHOE RACK

[76] Inventor: Doris N. Frankel, 4703 SE. 17th Pl., #101, Cape Coral, Fla. 33904

[21] Appl. No.: 614,854

[22] Filed: Nov. 15, 1990

[51] Int. Cl.[5] ..... A47F 7/00

[52] U.S. Cl. ..... 211/34; 211/37; 211/163

[58] Field of Search ..... 211/34, 36, 37, 163, 211/144, 131

[56] References Cited

U.S. PATENT DOCUMENTS

| | | | |
|---|---|---|---|
| 2,613,735 | 10/1952 | Fisher | 211/36 X |
| 2,941,669 | 6/1960 | Palay et al. | 211/163 X |
| 2,973,867 | 3/1961 | Cohen | 211/37 |
| 3,874,512 | 4/1975 | Wegley et al. | 211/163 |
| 4,036,367 | 7/1977 | Stambaugh et al. | 211/37 |
| 4,232,790 | 11/1980 | Serrano | 211/163 X |

FOREIGN PATENT DOCUMENTS

| | | | |
|---|---|---|---|
| 411053 | 5/1934 | United Kingdom | 211/37 |

*Primary Examiner*—Robert W. Gibson, Jr.
*Attorney, Agent, or Firm*—William E. Noonan

[57] ABSTRACT

A rotary shoe rack is disclosed for mounting in a storage space having generally fixed upper and lower surfaces. The rack includes a shaft that extends generally vertically between the upper and lower surfaces. There are upper and lower bearings rotatably mounting the upper and lower ends of the shaft, respectively, to the upper and lower surfaces of the storage space. A plurality of storage shelves are secured to the shaft at spaced apart intervals for supporting respective groups of shoes thereon. Each shelf is disposed about the shaft and has a generally horizontal platform that includes inner and outer sections. A heel support is attached to the inner section of the platform and is disposed about the shaft for elevating a heel portion of each shoe in the respective group above the platform such that a forward portion of the shoe is engagable with the outer section of the platform.

18 Claims, 4 Drawing Sheets

ROTARY SHOE RACK

FIELD OF THE INVENTION

This invention relates to a rotary shoe rack and, more particularly, to a shoe rack for use in residential closets and similar storage spaces.

BACKGROUND OF THE INVENTION

The space in most wardrobe closets is used quite inefficiently. Clothing is usually hung on racks; hats, boxes and other items are placed on shelves; and shoes are most often stored on the floor. However, much of the space between the floor and the closet shelves may not be utilized at all. Wasted space is a particular problem in corners of the closet, where access is difficult. Over time, the utilized areas of the closet tend to become crowded and disorganized. As a result, the inefficient use of closet space becomes even more noticeable.

The practice of storing shoes on the floor of the closet is annoying in several other respects. The homeowner must typically bend over in order to select a particular pair of shoes. Moreover, the shoes tend to collect dust and mildew when left to sit on the floor for extended periods of time.

Closet storage has been improved somewhat by the provision of shelf-like shoe racks that are mounted to the walls of the closet. However, these racks usually have a fairly limited depth and, as a result, there continues to be a considerable amount of wasted space in the closet. Moreover, the shoes still tend to become disorganized over time. Various other apparatuses have employed rotary cabinets or canisters for accommodating shoes. However, these devices typically do not provide for improved space saving organization or convenient, unobstructed viewing of the shoes. Also, they are often quite inconvenient to clean.

Recently, home and, in particular, closet organization has increased in popular concern. A new shoe storage rack is required that addresses that concern.

SUMMARY OF THE INVENTION

It is therefore an object of this invention to provide a rotary shoe rack that effectively stores a large number of shoes in a neat, secure and organized manner within a closet or similar storage space.

It is a further object of this invention to provide a rotary shoe rack that provides for improved, efficient use of closet space.

It is a further object of this invention to provide a shoe rack that permits even large numbers of shoes to be quickly and conveniently inspected.

It is a further object of this invention to provide a rotary shoe rack that protects shoes against dust and mildew.

It is a further object of this invention to provide a rotary shoe rack that is conveniently and readily assembled, disassembled and cleaned.

It is a further object of this invention to provide a rotary shoe rack that is attractive, resists rusting and is quite durable.

It is a further object of this invention to provide a shoe rack that is adjustable to fit various sizes of storage spaces and to accommodate various numbers of shoes.

This invention results from a realization that shoes may be stored in a closet with improved convenience, efficiency and organization by arranging groups of shoes in radial patterns on respective horizontal platforms that are mounted to rotate in unison in the closet. This invention results from a further realization that storage capacity is significantly increased and proper ventilation is maintained around the shoes by elevating the inner, heel end of each shoe above the platform.

This invention features a rotary shoe rack for mounting in a storage space that has generally fixed upper and lower surfaces. The rack includes a shaft that extends generally vertically between the upper and lower surfaces. There are upper and lower bearing means for rotatably mounting upper and lower ends of the shaft, respectively, to the upper and lower surfaces of the storage space. A plurality of storage shelves are secured to the shaft at spaced apart intervals for supporting respective groups of shoes thereon. Each shelf is disposed about the shaft and has a generally horizontal platform that includes inner and outer sections. Means are attached to the inner section of the platform and are disposed about the shaft for holding a heel portion of each shoe in the respective group elevated above the platform such that a forward portion of the shoe is engagable with the outer section of the platform.

In a preferred embodiment, the shaft may include means for adjusting the length of the shaft to generally correspond to the distance between the upper and lower surfaces. The means for adjusting may include a pair of telescopically and slidably engaged shaft segments and means for locking the segments together at selected positions to adjust the length of the shaft. Each of the shelves may be fixedly secured to and rotatable in unison with the shaft.

The shelf preferably has a circular peripheral shape and a central opening for receiving the shaft. The platform may include a solid, generally planar top surface. Means may be provided for releasably securing the storage shelf at selected positions along the shaft. The heel support means may include a rail that extends annularly about the shaft and is engagable by the heel portion, and a plurality of support posts mounted to the inner section of the platform for supporting the rail above the platform. The rail and platform may have a plurality of complementary grooves and each post may include an upper threaded end for engaging a respective groove in the rail and a reverse threaded lower end for simultaneously engaging the complementary groove in the platform. A plurality of spaced apart bushings may be mounted on the rail to prevent the heel portion from sliding off of the rail.

The shelf may include lip means disposed generally peripherally about the platform for confining the shoes in the respective group generally within the periphery of the shelf. The lip is preferably formed integrally with the platform.

BRIEF DESCRIPTION OF THE DRAWINGS

Other objects, features and advantages will occur from the following description of a preferred embodiment and the accompanying drawings, in which.

Figure 1:
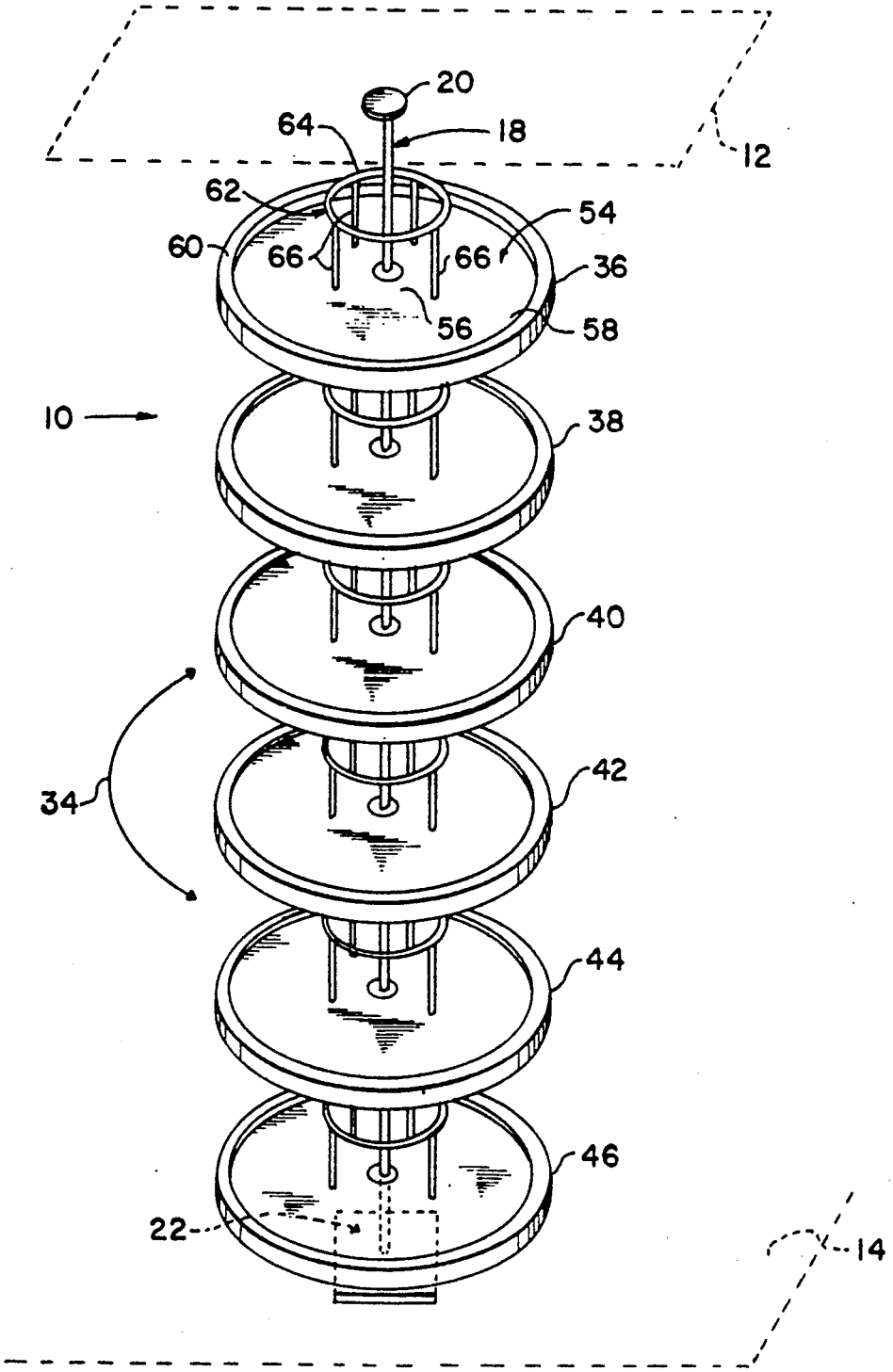
FIG. 1 is a perspective view of a rotary shoe rack according to this invention.

A rotary shoe rack according to this invention is constructed by rotatably mounting a vertical shaft between fixed upper and lower surfaces of a storage space. The fixed upper and lower surfaces may comprise the ceiling and floor of a residential wardrobe closet. Alternatively, the fixed upper surface may include the bottom of a conventional storage shelf in the closet. The shaft is typically composed of a pair of metal or plastic rod-like segments, which are telescopically and slidably engaged so that the shaft may be adjusted to the distance between the fixed upper and lower surfaces. Alternatively, a fixed shaft may be employed. Various types of bearings may be employed to mount the upper and lower ends of the shaft within the closet. These may comprise, for example, steel/delrin pivot bearings, such as are employed in rotatable pantry shelves. A wide variety of alternative bearings may also be employed.

Two or more storage shelves are secured to the shaft at spaced apart intervals for supporting respective groups of shoes. In alternative embodiments, a single shelf may be used. Each shelf is preferably circular in shape and is disposed entirely about the shaft. The shelf includes a generally horizontal platform having a preferably solid, planar top surface. The platform also has inner and outer annular sections.

A heel support structure is mounted on the inner section of the platform and is formed about the shaft, preferably in an annular arrangement, for elevating the heels of shoes placed on the shelf above the platform. As a result, a forward portion of each shoe is engagable with the outer section of the platform. As used herein, the heel portion of the shoe refers to the heel itself or to a region located generally beneath the wearer's heel. The forward portion of the shoe generally refers to that portion of the shoe proximate the toe or ball of the foot. Because the heels of the shoes are elevated above the platform, storage capacity is increased considerably and proper ventilation is maintained around the shoes and mildew is resisted. Storage capacity is increased because the inner circumference formed by the heels of the shoes is increased. As a result, a greater number of shoes may be arranged about each shelf. The heel support may comprise an annular rail that is formed about the shaft and a plurality of mounting posts that are attached to the inner section of the platform for supporting the rail above the platform. The rail may be formed of any suitable plastic or metal material. The posts are typically composed of wood, although various metals and plastics may also be utilized. Typically, the upper and lower ends of each post have reversed threads so that each post may be simultaneously engaged with complementary grooves in the platform and the rail. In certain embodiments, bushings, such as rubber washers, may be employed on the rail so that the heel portions of flats or similar footwear do not slip off of the rail.

Although in the embodiments described herein a circular or annular heel support is disclosed, in alternative embodiments the heel support may have other (e.g. square, octagonal, pentagonal, etc.) configurations. Such heel supports are particularly useful for men's shoes, which typically have larger heels that would not fit well on a circular support.

Preferably, a lip or ridge is formed peripherally about the platform. The lip forms a peripheral border for the shelf so that shoes that are placed on the shelf are confined within the periphery of the shelf. As a result, the shoes are prevented from slipping or being knocked from the shelves. Additionally the shoes are prevented from coming into contact with clothing hanging adjacent the shoes. Typically, the lip is formed integrally with the platform. The shelf, including the platform and the lip, is preferably composed of a rugged and yet preferably light weight molded plastic material that resists rusting, although alternative materials may be used. Preferably the material should be easy to clean and resistent to mildew, staining and damage.

The shelves are secured at selected intervals along the shaft. Preferably, a releasable bracket or some other means is employed so that the location of the shelves may be adjusted to remove, add, or reposition a shelf as required. Each shelf is typically attached securely to the shaft so that all of the shelves rotate in unison with the shaft. As a result, the homeowner is able to rotate the entire apparatus and view all of the shoes quickly and conveniently. The apparatus presents a neat, attractive and organized appearance, unlike the cumbersome racks of the prior art.

Figure 2:
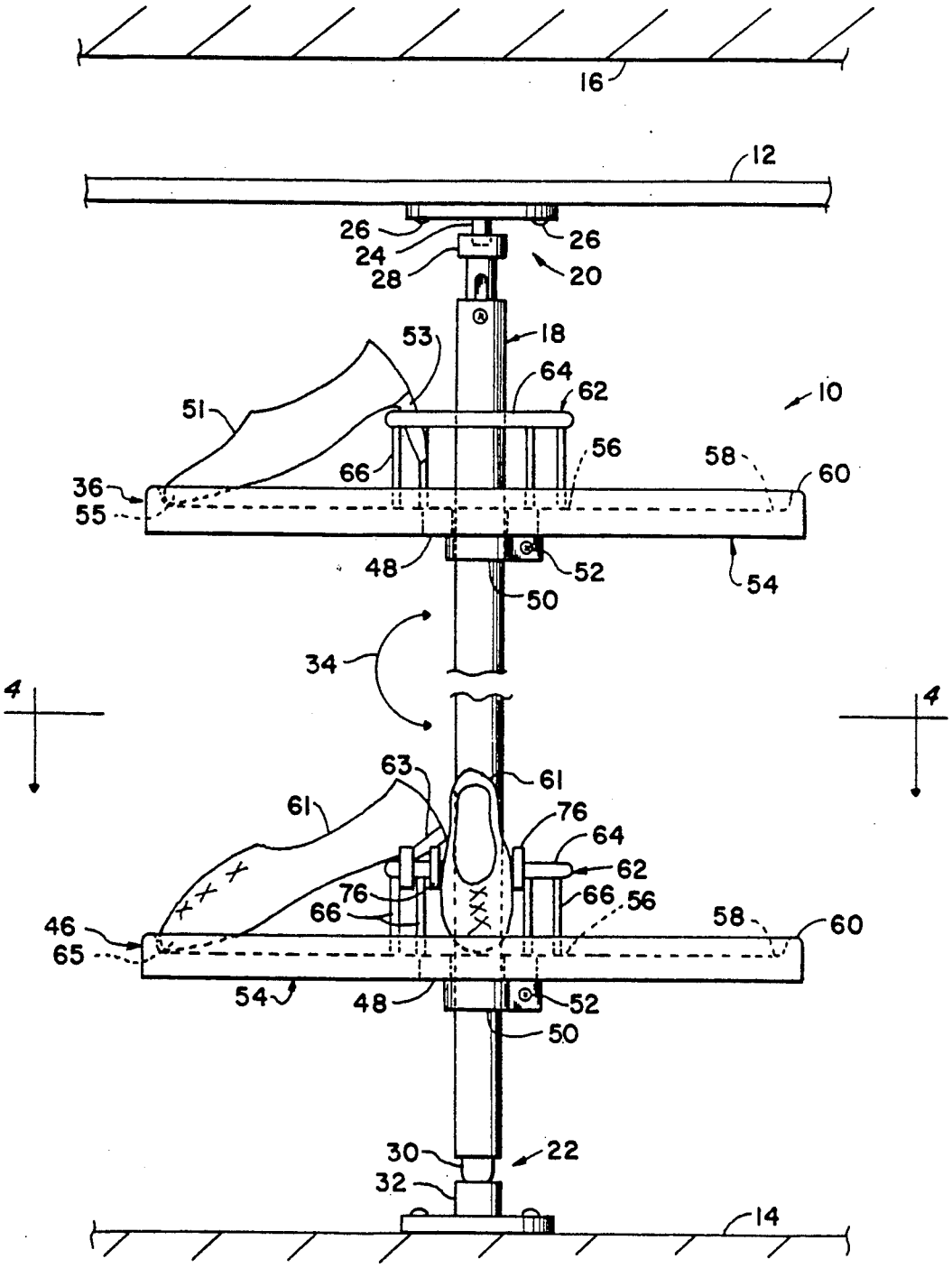
FIG. 2 is partial, elevational view of the shoe rack.

There is shown in FIG. 1 a rotary shoe rack 10 that is mounted between generally horizontal upper and lower surfaces 12 and 14, respectively. These surfaces may be located in a conventional residential closet or other storage space. More particularly, surface 12 may comprise a closet shelf, as illustrated in FIG. 2. Alternatively, the upper end of rack 10 may be mounted to the ceiling 16 of the closet.

As shown in FIGS. 1 and 2, rack 10 includes an elongate shaft 18 that extends generally between upper surface 12 and lower surface 14. The shaft is rotatably attached at its upper and lower ends to surfaces 12 and 14, respectively, by bearings 20 and 22. As shown more clearly in FIG. 2, bearing 20 comprises a pivot element 24 carried by a mounting plate that is mounted to closet shelf 12 by screws 26 and a bearing socket 28 that is formed at the upper end of shaft 18 for pivotably receiving element 24. If the upper shelf is a wire or ventilated shelf, appropriate alternative means may be employed to mount the bearing 20 to the shaft. The lower end of shaft 18 carries an element 30 that rotatably engages bearing socket 32, which is attached to floor 14. With the upper and lower ends of shaft 18 pivotably mounted to shelf 12 and floor 14 in this manner, the shaft is permitted to rotate in the direction of double headed arrow 34.

Figure 3:
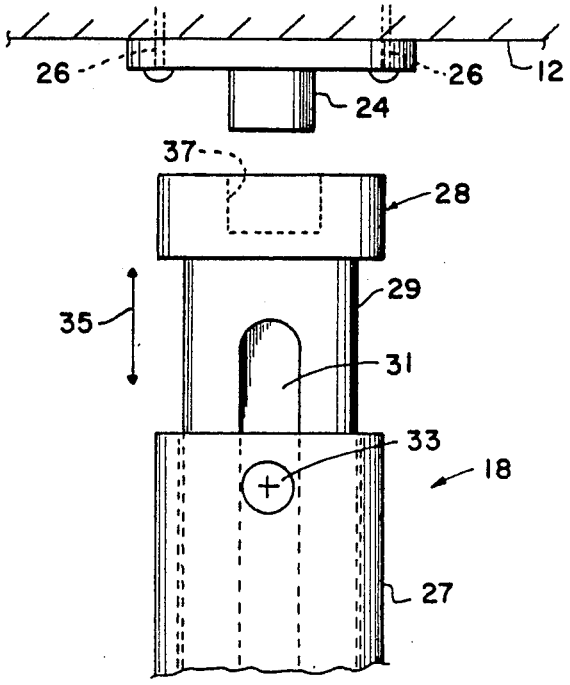
FIG. 3 is an elevational view of the upper end of the adjustable shaft.

As best shown in FIG. 3, the length of shaft 18 is adjustable so that it can be mounted in closets of various sizes. Specifically, shaft 18 includes slidably and telescopically engaged outer and inner segments 27 and 29. Bearing socket 28 is formed at the outer end of segment 29. An elongate recess 31 is formed in the inner segment and a set screw 33 formed through outer segment 27 is selectively tightened to engage recess 31 and lock segments 27 and 29 together at a desired length. To mount shaft 18 in the closet, as shown in FIG. 2, bearing element 24 and bearing socket 32 are attached to shelf 12 and floor 14, respectively. Bearing element 30 is engaged with socket 32 and, as shown in FIG. 3, shaft segments 27 and 29 are adjusted as indicated by double headed arrow 35 until bearing socket 28 is positioned just below bearing element 24. Segment 29 is then extended out from segment 27 until receptacle 37 of socket 28 receives bearing element 24. Finally, set screw 33 is tightened against recess 31 so that segments 27 and 29 are locked in place and shaft 18 has an appropriate length and is rotatably mounted within the storage space. For use in conventional closets, an adjustable height of approximately 60 to 72 inches is desirable.

Figure 4:
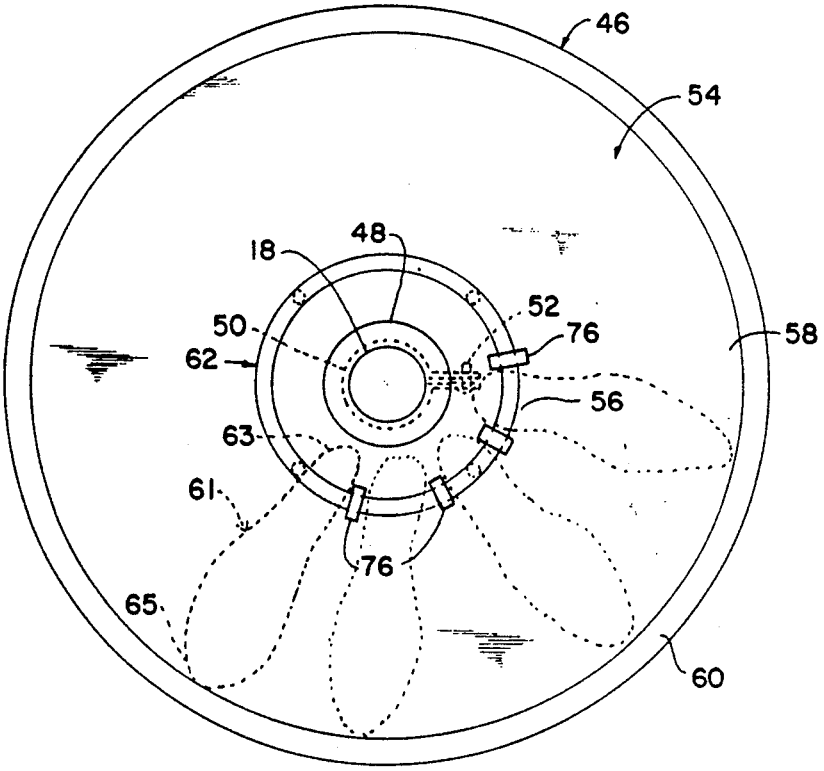
FIG. 4 is a cross sectional view taken along line 4—4 of FIG. 2.

Six shelves, 36, 38, 40, 42, 44 and 46, FIG. 1, are secured to shaft 18 at predetermined intervals. In alternative embodiments, various other numbers of shelves may be employed. As best shown in FIGS. 1 and 4, each shelf has a circular configuration and is disposed symmetrically about shaft 18 such that the shaft extends through a central opening in each of the shelves. Each shelf includes an annular collar 48 that surrounds shaft 18. A clamp 50, FIGS. 2 and 4, depends from each such collar below its respective shelf. Clamp 50 surrounds shaft 18 and includes a screw 52 that is tightened to fix the respective shelf to shaft 18. The location of shelves 36 through 46 along shaft 18 may be subsequently adjusted by loosening screws 52 and clamps 50 and repositioning or removing the shelves as desired.

Figure 5:
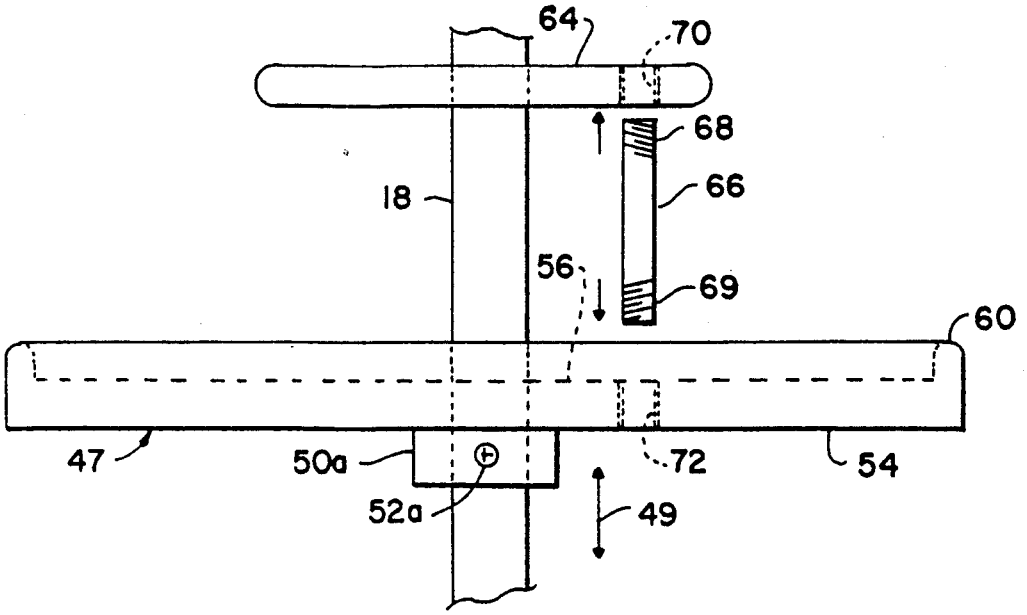
FIG. 5 is an elevational, partly exploded view of a single shelf and heel supporting means and an alternative bracket for adjustably securing the shelf to the shaft.

An alternative clamp 50*a* is shown in FIG. 5. Therein, a set screw 52*a* is employed to secure the clamp, as well as the attached shelf to shaft 18. Set screw 52*a* is selectively loosened to adjust shelf 47, as indicated by double headed arrow 49.

As illustrated in FIGS. 1, 2 and 4, each shelf includes a generally horizontal platform portion 54 that is disposed annularly about shaft 18. Platform 54 has a solid, planar top surface and includes a generally annular inner section 56 and an annular outer section 58. An annular lip 60 is formed peripherally about platform 54 and is typically integral with the platform.

Heel support means 62 are mounted on inner section 56 of platform 54. As best shown in FIGS. 1 and 2, each heel support means 62 includes an annular rail 64 that is disposed about shaft 18. The rail is supported above platform 54 by four support posts 66 that are mounted to inner section 56 of platform 54. More particularly, as indicated in FIG. 5, each support post 66 includes a threaded upper end 68 and a reverse threaded lower end 69. Rail 64 includes four grooves 70 formed at regular intervals therein and inner section 56 of platform 54 includes four complementary grooves 72. Post 66 is engaged with rail 64 and platform 54 by engaging its threads 68 with a respective groove 70 in rail 64 and simultaneously engaging reverse threads 69 with a groove 72 in platform 54. Each of the posts 66 is attached to the platform and the rail in a similar manner so that the rail is held approximately five inches above the platform. A plurality of rubber or plastic bushings 76 are mounted to rail 64 above shelf 46, as shown in FIGS. 2 and 4. Such bushings may be used on any of the rails.

Rack 10 is assembled and operates in the following manner. Heel support means 62 are secured to each of the shelves 36 through 6 in the manner shown in FIG. 5. Each of the shelves is then slid onto shaft 18 and lowest shelf 46 is secured at a desired location along the shaft by tightening its clamp. The remaining shelves are stacked above shelf 46. Appropriate bearing elements, such as elements 24 and 32, are mounted to the fixed upper and lower surfaces of the closet. The shaft is then adjusted, as shown in FIG. 5, so that the rack 10 is rotatably engaged at its upper and lower ends to the fixed upper and lower surfaces of the closet or other storage space. The rack is thus fully deployed. The remaining shelves are then positioned as desired and tightened.

Respective pairs of groups of shoes are arranged on the shelves 36 through 46. Each shelf supports groups or pairs of either men's or women's shoes in a generally radial arrangement, i.e. each shoe points radially outwardly relative to the shaft.

In FIG. 2, a high heel shoe 51 is supported on shelf 36. Shoe 51 is pointed generally radially outwardly from its heel portion 53 to its forward or toe portion 55. Heel portion 53 extends over and through rail 64 of heel support 62. As a result, heel portion 53 is elevated above platform 54. Forward portion 55 extends generally outwardly and downwardly and engages outer section 58 of platform 54. Lip 60 confines shoe 51 to the periphery of shelf 36 and helps to prevent the shoe from slipping or falling off of the shelf. By elevating heel portion 53 above platform 54, proper ventilation is maintained around shoe 51 so that mildew does not collect on the sole of the shoe. Moreover, elevating the heel increases the inner circumference of the arrangement of shoes and therefore permits a greater number of pairs to be accommodated on each shelf.

Flats or similar shoes 61 are supported on shelf 46, FIGS. 2 and 4. The heel portion 63 of each shoe 61 engages the rail 64 of heel support 62 and, as a result, heel portion 63 is elevated above platform 54 so that proper circulation is maintained around the shoes and shoe capacity is increased. Forward portion 65 of shoe 61 extends generally outwardly and downwardly from the annular rail 64 and engages outer portion 58 of platform 54. Because heel portion 63 is minimal or virtually level with the remainder of the sole of shoe 61, such shoes have a tendency to slip off of a bare rail 64, such as is used on shelf 36. This problem is significantly reduced by employing annular bushings 76 on either side of shoe 61. Bushings 76 hold the shoe fairly securely in place on or against the rail. Once again, lip 60 confines shoes 61 generally to the periphery of shelf 46 and prevents those shoes from sliding radially off the shelf. Preferably each of the shelves is spaced approximately 10 inches apart so that unobstructed access to and viewing of the shoes is permitted. Because each of the shelves is fixed to the rotatable shaft, the entire rack may be rotated by turning just one of the shelves. This permits all of the shoes to be quickly and conveniently inspected and accessed during a single rotation of the rack.

By adding or subtracting shelves, varying numbers of shoes may be accommodated. Although it is not a limitation of this invention, a preferred shelf diameter is approximately 22 inches. Such a shelf can comfortably accommodate five pairs of shoes and fit satisfactorily within the space available in most wardrobe closets. Accordingly, a rack that includes six shelves of this type can comfortably accommodate at least 30 pairs of shoes.

To disassemble rack 10, screw 33 is loosened and element 29 is retracted into element 27. This disengages bearing socket 28 from bearing element 24. Lower element 30 is then removed from bearing socket 32 so that rack 10 is free to be relocated.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. A rotary shoe rack for mounting in a storage space having generally fixed upper and lower surfaces, said rack comprising:

a shaft that extends generally vertically between said upper and lower surfaces;

upper and lower bearing means for rotatably mounting upper and lower ends of said shaft, respectively, to said upper and lower surfaces of said storage space;

a plurality of storage shelves secured to said shaft at spaced apart intervals for supporting respective groups of shoes thereon, at least one said shelf being disposed about said shaft and having a generally horizontal platform that includes inner and outer sections; and heel support means attached to said inner section of said platform and being disposed about said shaft for elevating a heel portion of each shoe in said respective group above said platform such that a forward portion of said shoe is engaged with said outer section of said platform, said heel support means including a rail that extends annularly about said shaft and is engageable by the heel portion and a plurality of support posts mounted to said inner section of said platform for supporting said rail above said platform.

2. The rack of claim 1 in which said shaft includes means for adjusting the length of said shaft to generally correspond to the distance between said upper and lower surfaces.

3. The rack of claim 2 in which said means for adjusting include a pair of telescopically and slidably engaged shaft segments and means for locking said segments together at selected positions to adjust the length of said shaft.

4. The rack of claim 1 in which said platform includes a solid, generally planar top surface.

5. The rack of claim 1 further including means for releasably securing said storage shelf at selected positions along said shaft.

6. The rack of claim 1 in which said rail and said platform have a plurality of complementary grooves and each said post includes an upper threaded end for engaging a respective said groove in said rail and a reverse threaded lower end for engaging a complementary said groove in said platform.

7. The rack of claim 1 in which a plurality of spaced apart bushings are mounted on said rail to prevent a heel portion that engages said rail from sliding off of said rail.

8. The rack of claim 1 in which each of said shelves is fixedly secured to and rotatable in unison with said shaft.

9. The rack of claim 1 in which each shelf has a generally circular peripheral shape.

10. A rotary shoe rack for a storage space having generally fixed upper and lower surfaces, said rack comprising:

a shaft that extends generally vertically between said upper and lower surfaces;

upper and lower bearing means for rotatably mounting upper and lower ends of said shaft, respectively, to said upper and lower surfaces;

a plurality of shelves secured to said shaft at spaced apart intervals for supporting respective groups of shoes; each said shelf being disposed about said shaft and including a generally horizontal platform portion that has inner and outer sections; and heel support means including a rail that extends annularly about said shaft and a plurality of support posts mounted to said inner section of said shelf for supporting said rail above said platform; said rail being engagable by a heel portion of each shoe in said respective group to elevate said heel portion above said platform such that a forward portion of said shoe is engagable with said outer section of said platform; said shelf further including lip means disposed peripherally about said platform for generally confining said shoes in said respective group within the periphery of said shelf.

11. A rotary shoe rack for a storage space having generally fixed upper and lower surfaces, said rack comprising:

a shaft that extends generally vertically between said upper and lower surfaces;

upper and lower bearing means for rotatably mounting upper and lower ends of said shaft, respectively, to said upper and lower surfaces;

a plurality of shelves secured to said shaft at spaced apart intervals for supporting respective groups of shoes; each said shelf being disposed about said shaft and including a generally horizontal platform portion that has inner and outer sections; and heel support means attached to said inner section of said platform and being disposed about said shaft for elevating a heel portion of each shoe in said respective group above said platform such that a forward portion of said shoe is engageable with said outer section of said platform; said shelf further including lip means disposed peripherally about said platform for generally confining said shoes in said respective group within the periphery of said shelf.

12. The rack of claim 11 in which said lip is formed integrally with said platform.

13. The rack of claim 11 in which said shaft includes means for adjusting the length of said shaft to generally correspond to the distance between said upper and lower surfaces.

14. The rack of claim 13 in which said means for adjusting include a pair of telescopically and slidably engaged shaft segments and means for locking said segments together at selected positions to adjust the length of said shaft.

15. The rack of claim 11 in which said platform includes a solid, generally planar top surface.

16. The rack of claim 11 further including means for releasably securing said storage shelf at selected positions along said shaft.

17. The rack of claim 11 in which each of said shelves is fixedly secured to and rotatable in unison with said shaft.

18. The rack of claim 11 in which each shelf has a generally circular peripheral shape.

* * * * *